US006601785B2

(12) United States Patent
Bulgatz et al.

(10) Patent No.: US 6,601,785 B2
(45) Date of Patent: Aug. 5, 2003

(54) SELF-LOCKING SPRING STOP FOR FUEL INJECTOR CALIBRATION

(75) Inventors: Dennis Bulgatz, Williamsburg, VA (US); Robert McFarland, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 3 days.

(21) Appl. No.: 09/870,999

(22) Filed: Jun. 1, 2001

(65) Prior Publication Data

US 2002/0179747 A1 Dec. 5, 2002

(51) Int. Cl.[7] ..... B05B 1/30; F02M 51/00; F02M 59/00

(52) U.S. Cl. ..... 239/585.1; 239/585.3; 239/585.4; 239/585.5; 239/533.2

(58) Field of Search ..... 239/585.1, 585.3, 239/585.4, 585.5, 533.1, 533.2, 533.3, 533.7, 533.9, 5, 600, 533.8; 251/127, 129.15, 129.21

(56) References Cited

U.S. PATENT DOCUMENTS 4,312,479 A * 1/1982 Tolan ..... 239/86
4,313,571 A 2/1982 Bellicarde et al. ..... 239/585
4,346,847 A * 8/1982 Rissi ..... 239/585
4,423,843 A * 1/1984 Palma ..... 239/585
4,575,009 A 3/1986 Glraudi ..... 239/585
4,899,699 A 2/1990 Huang et al. ..... 123/83
4,946,107 A 8/1990 Hunt ..... 239/585
5,299,919 A * 4/1994 Paul et al. ..... 417/387
5,301,874 A 4/1994 Vogt et al. ..... 239/585.4
5,330,153 A 7/1994 Reiter ..... 251/129.21
6,267,306 B1 * 7/2001 Phillips et al. ..... 239/585.1

* cited by examiner

*Primary Examiner*—Davis D. Hwu

(57) ABSTRACT

A fuel injector has a fuel inlet, a fuel outlet, and a fuel passageway extending along an axis between the fuel inlet and the fuel outlet. The fuel injector comprises a body, an armature, a spring, and a spring stop. The body has an inlet portion, an outlet portion, and a passage disposed between the inlet portion and the outlet portion. The armature is disposed within the passage and is displaceable along the axis relative to the body. The spring is disposed within the passage and applies a biasing force to the armature. The spring has a first end disposed proximate the armature and a second end opposite from the first end. The spring stop is disposed within the passage and has a first and second portion. The first portion includes at least one projection engaging the passage. The at least one projection extends obliquely with respect to the axis and in a direction general toward the inlet portion.

14 Claims, 2 Drawing Sheets

FIG. 2A
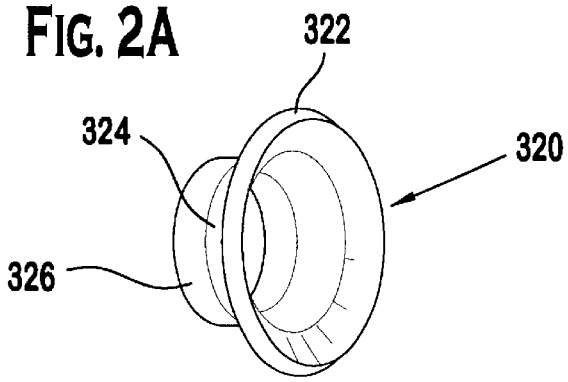
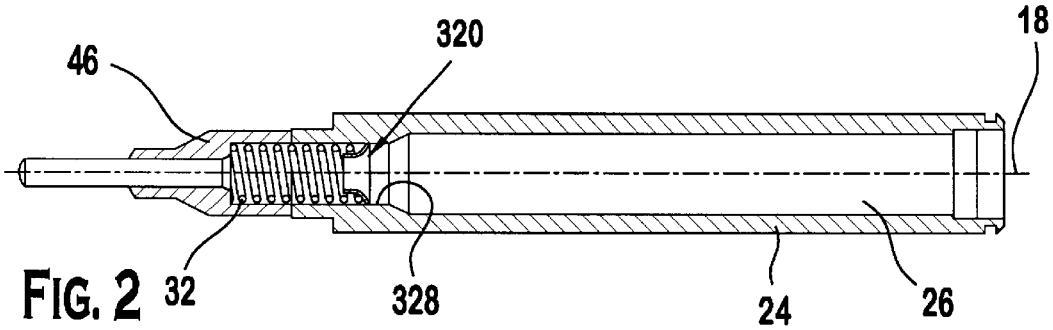
FIG. 2
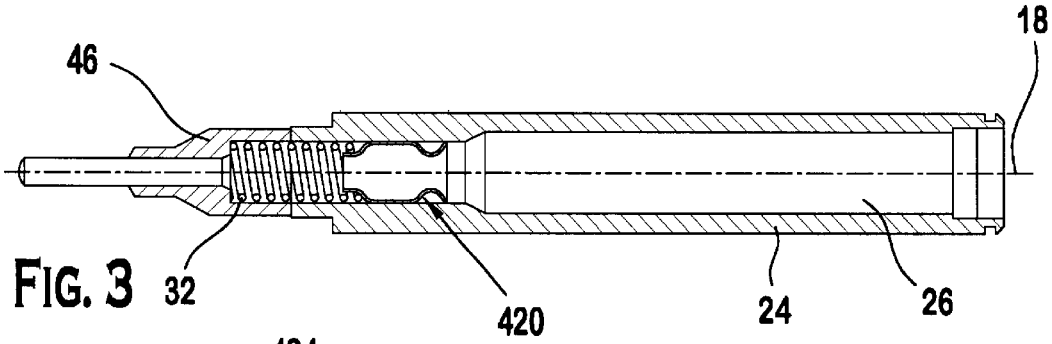
FIG. 3
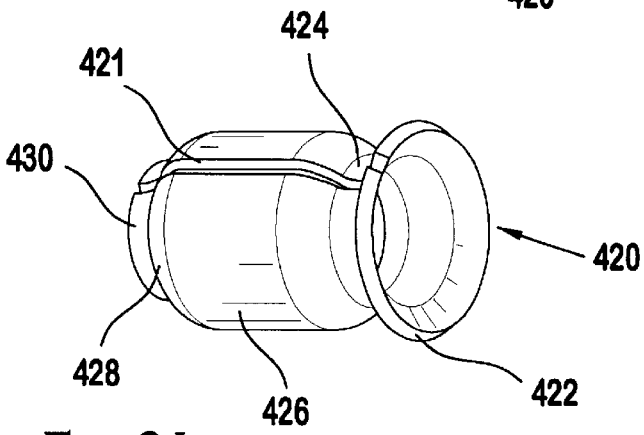
FIG. 3A

SELF-LOCKING SPRING STOP FOR FUEL INJECTOR CALIBRATION

FIELD OF THE INVENTION

This invention relates in general to a fuel injector assembly, and more specifically to a fuel injector assembly having a self-locking calibration member that sets spring bias and provides a seat that allows spring alignment.

BACKGROUND OF THE INVENTION

It is believed that in a conventional fuel injector assembly, a spring is disposed between an end of an adjustment tube and an armature. To allow fuel to flow through the injector, the adjustment tube is usually hollow. It is known to use an adjustment tube to initially set, i.e., calibrate, the dynamic flow of a conventional fuel injector assembly by either altering the amount of metal in the magnetic circuit or by adjusting the spring preload. In the fuel injector industry, adjusting the spring preload is the most common calibration method.

Two types of adjustment tubes are known for adjusting the spring preload: an interference fit adjustment tube and a free sliding adjustment tube. An interference fit adjustment tube requires a large force to position the adjustment tube with respect to its mating part and is considered fixed when the tooling no longer applies the force needed to move the adjustment tube. Interference-type adjustment tubes can be continuous tubes or axially slit tubes, which are commonly referred to as "roll pins." A roll pin allows the mating hole size to vary significantly, and moving the roll pin requires less force than moving the continuous tube. However, under severe conditions, the roll pin may be displaced, thus altering the previously calibrated dynamic flow of the fuel injector. The continuous tube is less susceptible to unanticipated displacement due to its higher engagement force, but does require precision machining.

Conventional interference-type adjustment tubes have several disadvantages. One disadvantage is that moving the adjustment tube to calibrate a fuel injector requires a relatively large force. Although moving a roll pin requires less force than moving a continuous tube, a roll pin has the disadvantage of being susceptible to displacement under severe conditions. While a continuous tube is less likely to be displaced than a roll pin because of its higher engagement force, a disadvantage of the continuous pin is that it requires precise machining.

In contrast to interference-type adjustment tubes, a free sliding adjustment tube slides freely with respect to its mating part such that spring preload adjustments can be made quickly. Once the desired spring preload is achieved, the adjustment tube is fixed in position by a staking process with respect to the mating part.

SUMMARY OF THE INVENTION

The present invention provides a fuel injector. The fuel injector has a fuel inlet, a fuel outlet, and a fuel passageway extending along an axis between the fuel inlet and the fuel outlet. The fuel injector comprises a body, an armature, a spring, and a spring stop. The body has an inlet portion, an outlet portion, and a passage disposed between the inlet portion and the outlet portion. The armature is disposed within the passage and is displaceable along the axis relative to the body. The spring is disposed within the passage and applies a biasing force to the armature. The spring has a first end disposed proximate the armature and a second end opposite from the first end. The spring stop is disposed within the passage and has a first and second portion. The first portion includes at least one projection engaging the passage. The at least one projection extends obliquely with respect to the axis and in a direction general toward the inlet portion.

The present invention also provides a method of assembling a fuel injector. The fuel injector has a fuel inlet, a fuel outlet, a fuel passageway extending along an axis between the fuel inlet and the fuel outlet. The fuel injector includes an armature and a body that has an inlet portion, an outlet portion, and a passage extending between the inlet portion and the outlet portion. The method comprises disposing within the passage the armature displaceable along the axis relative to the body, disposing within the passage a spring applying a biasing force to the armature, maintaining a seat in a first configuration adapted for applying a first pressure on the passage, positioning the seat in the first configuration at a location along the axis with respect to the body for applying the biasing force, and releasing the seat to a second configuration adapted for applying a second pressure on the passage. The spring has a first end disposed proximate the armature and a second end opposite from the first end. And the second pressure is greater than the first pressure.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

FIG. 2 is a cross-sectional view of the fuel injector assembly according to a first embodiment.

FIG. 2A is a perspective view of the spring stop shown in FIG. 2.

FIG. 3 is a cross-sectional view, which is similar to FIG. 2, of a portion of a fuel injector assembly according to a second embodiment.

FIG. 3A is a perspective view of the spring stop shown in FIG. 3.

DETAILED DESCRIPTION OF THE PREFERRED EMBODIMENTS

Figure 1:
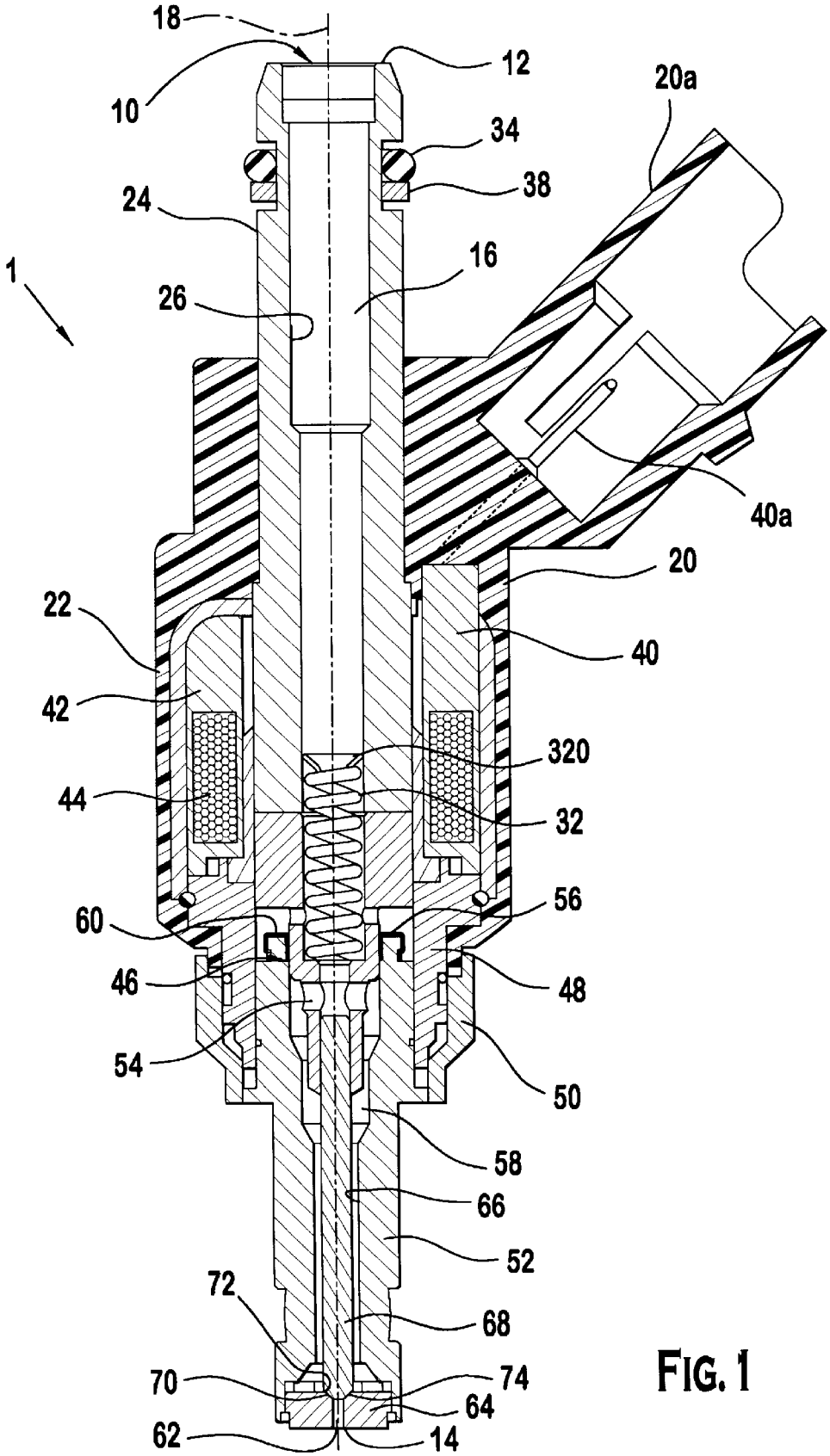
FIG. 1 is a cross-sectional view of a fuel injector assembly according to a first embodiment.

Referring to FIGS. 1, 2, and 2A, a fuel injector assembly 1 has a fuel inlet 12, a fuel outlet 14, and a fuel passageway 16 extending from the fuel inlet 12 to the fuel outlet 14 along a longitudinal axis 18. The fuel injector assembly 1 also includes an overmolded plastic member 20 cincturing a metallic support member 22.

A fuel inlet member 24 with an inlet passage 26 is disposed within the overmolded plastic member 20. The inlet passage 26 serves as part of the fuel passageway 16 of the fuel injector assembly 1. A fuel filter (not shown) and an armature bias spring 32 are provided in the inlet passage 26. The armature bias spring 32 can be a coil spring. In combination with other factors, the length of the spring 32, and hence the bias force of the spring 32, affect the quantity of fuel flow through the injector. The overmolded plastic member 20 also supports a socket **20*a* that receives a plug (not shown) to operatively connect the fuel injector assembly 1 to an external source of electrical potential, such as an electronic control unit (not shown). An elastomeric O-ring 34 is provided in a groove on an exterior of the inlet member 24. The O-ring 34 is supported by a backing ring 38 to sealingly secure the inlet member 24** to a fuel supply member (not shown), such as a fuel rail.

The metallic support member 22 encloses a coil assembly 40. The coil assembly 40 includes a bobbin 42 that retains a coil 44. The ends of the coil assembly 40 are electrically connected to pins 40*a* mounted within the socket 20*a* of the overmolded plastic member 20. An armature 46 is supported for relative movement along the axis 18 with respect to the inlet member 24. The armature 46 can be supported by an armature guide eyelet 56 that is located on an inlet portion 60 of a valve body 52 for relative axial sliding movement with respect to the valve body 52. A non-magnetic sleeve 48 positions the coil assembly 40 with respect to the valve body 52 and a shell 50 provides a magnetic path between the metallic support member 22 and the valve body 52. The armature 46 has an armature passage 54 in fluid communication with the inlet passage 26.

An axially extending body passage 58 connects the inlet portion 60 of the body 52 with an outlet portion 62 of the body 52. The armature passage 54 of the armature 46 is in fluid communication with the body passage 58 of the body 52. A seat 64 is mounted at the outlet portion 62 of the body 52.

The body 52 includes a neck portion 66 that extends between the inlet portion 60 and the outlet portion 62. The neck portion 66 can be an annulus that surrounds a substantially cylindrical needle 68. The needle 68 is operatively connected to the armature 46, and is centrally located within and spaced from the neck portion 66 so as to define a part of the body passage 58. The cylindrical needle 68 is substantially axially aligned with the longitudinal axis 18 of the fuel injector assembly 1.

The fuel injector assembly 1 operates by magnetically coupling the armature 46 to the end of the inlet member 26 that is closest to the inlet portion 60 of the body 52. Thus, the lower portion of the inlet member 26 that is proximate to the armature 46 serves as part of the magnetic circuit formed with the armature 46 and coil assembly 40. The armature 46 is guided by the armature guide eyelet 56 and is responsive to an electromagnetic force generated by the coil assembly 40 for axially reciprocating the armature 46 along the longitudinal axis 18 of the fuel injector assembly 1. The electromagnetic force is generated by current flow from the electronic control unit (not shown) through the coil assembly 40. Movement of the armature 46 also moves the operatively attached needle 68 to positions that are either separated from or contiguously engaged with the seat 64. This opens or closes, respectively, the seat passage 70 of the seat 64, which permits or prevents, respectively, fuel from flowing through the fuel outlet 14 of the fuel injector assembly 1. The needle 68 includes a curved surface 74 for contiguously engaging with a conical portion 72 of the seat passage 70.

Fuel that is to be injected into a combustion chamber (not shown) by the fuel injector assembly 1 is communicated from the fuel inlet source (not shown), to the fuel inlet 12, through the fuel passageway 16, and exits from the fuel outlet 14. The fuel passageway 16 includes the inlet passage 26 of the inlet member 24, the armature passage 54 of the armature 46, the body passage 58 of the body 52, and the seat passage 70 of the seat 64.

In order to ease the assembly of a fuel injector, it is desirable to minimize the force required to position the adjustment member while calibrating the fuel injector. Further, it is desirable to lock the adjustment member following calibration, without requiring a precisely machined adjustment member.

Referring to FIGS. 2 and 2A, a first preferred embodiment of an adjustment member includes a spring stop 320 disposed within the inlet passage 26 and adjacent to the spring 32. The adjustment member 320 is positionable along the axis 18, thereby varying the length of the spring 32. The spring stop 320 includes a flared end 322 and a seat 324 that slidably engages the first end of the spring 32 and can include a projection 326. The length of the spring stop 320 is significantly less than the length of the inlet member 24 in the fuel injector assembly 1. The spring stop 320 can have an axial slit (not shown).

During installation, an installation tool (not shown) is placed through the spring stop 320. The installation tool has a shoulder proximate the inner diameter of the flared end 322 compressing the outer diameter of the flared end 322 thus permitting the spring stop 320 to slide substantially freely along the axis 18.

When the installation tool is released, the flared end 322 will return substantially to its original diameter and exert a pressure on the inlet passage 26 for locking the spring stop 320 substantially proximate the location along the axis 18 at which the installation tool was released. The inlet passage 26 can have a knurled or threaded surface 328 frictionally engaging the flared end 322 thus providing additional locking force.

The seat 324 has a generally concave surface. The projection 326 aligns the first end of the spring 32 substantially along the axis 18. The projection 326 can be tapered such that only inactive coils of the spring 32 are engaged. The seat 324 and the projection 326 can be annular, thereby permitting fluid communication through the seat 324.

Referring now to FIGS. 3 and 3A, a second preferred embodiment of an adjustment member includes a spring stop 420 disposed within the inlet passage 26 and adjacent to the spring 32. The spring stop 420 is positionable along the axis 18, thereby varying the length of the spring 32. The spring stop 420 includes a flared end 422, a groove 424, a body 426, and a seat 428 that slidably engages the first end of the spring 32 and can include a projection 430. The length of the spring stop 420 is significantly less than the length of the adjustment tube 30 in the fuel injector assembly 1. The spring stop 420 can have an axial slit 421.

During installation, an installation tool (not shown) attaches to the spring stop 420 proximate the inner diameter of the flared end 422 compressing the outer diameter of the flared end 422 thus permitting the spring stop 420 to slide substantially freely along the axis 18. As the spring stop 420 slides along the axis 18, material at the interface of the inlet passage 26 and the spring stop 420 that becomes free will be retained within the groove 424.

When the installation tool is released, the flared end 422 will return substantially to its original diameter and exert a pressure on the inlet passage 26 locking the spring stop 420 substantially proximate the location along the axis 18 at which the installation tool was released. The inlet passage 26 can have a knurled or threaded surface 432 frictionally engaging the flared end 422 thus providing additional locking force.

The seat 428 has a generally concave surface. The projection 430 aligns the first end of the spring 32 substantially along the axis 18. The projection 430 can be tapered such that only inactive coils of the spring 32 are engaged. The seat 428 and the projection 430 can be annular, thereby permitting fluid communication through the seat 428.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector having a fuel inlet, a fuel outlet, and a fuel passageway extending along an axis between the fuel inlet and the fuel outlet, the fuel injector comprising:

a body having an inlet portion, an outlet portion, and a passage disposed between the inlet portion and the outlet portion;

an armature disposed within the passage and displaceable along the axis relative to the body;

a spring disposed within the passage and applying a biasing force to the armature, the spring having a first end disposed proximate the armature and a second end opposite from the first end, the spring having an outside diameter; and a spring stop disposed within the passage and having a first and second portion, the first portion including at least one projection engaging the passage, the at least one projection extending obliquely with respect to the axis and in a direction generally toward the inlet portion, the spring stop having an open cross-sectional area that permits fuel flow therethrough, the open cross-sectional area defining a distance transverse to and coincident to the axis, the transverse distance being greater than the outside diameter of the spring.

2. The fuel injector according to claim 1, wherein the passage comprises a knurled surface frictionally engaging the second portion.

3. The fuel injector according to claim 1, wherein the passage comprises screw threads threadably engaging the second portion.

4. The fuel injector according to claim 1, wherein the spring stop comprises an axial slit.

5. The fuel injector according to claim 1, wherein the spring stop comprises a length no greater than 20 percent of a length of the body.

6. The fuel injector according to claim 1, wherein the spring comprises a coil spring.

7. The fuel injector according to claim 1, wherein the spring comprises a seat, the spring and seat are substantially aligned along the axis.

8. The fuel injector according to claim 1, wherein the seat is annular so as to permit fluid communication through the seat.

9. A fuel injector having a fuel inlet, a fuel outlet, and a fuel passageway extending along an axis between the fuel inlet and the fuel outlet, the fuel injector comprising:

a body having an inlet portion, an outlet portion, and a passage disposed between the inlet portion and the outlet portion;

an armature disposed within the passage and displaceable along the axis relative to the body;

a spring disposed within the passage and applying a biasing force to the armature, the spring having a first end disposed proximate the armature and a second end opposite from the first end; and a spring stop disposed within the passage and having a first and second portion, the first portion including at least one projection engaging the passage, the at least one projection extending obliquely with respect to the axis and in a direction generally toward the inlet portion, wherein the second portion comprises a seat slidably engaging one of the first and second ends.

10. The fuel injector according to claim 9, wherein the second portion comprises an axially extending body slidably engaging the passage.

11. A fuel injector having a fuel inlet, a fuel outlet, and a fuel passageway extending along an axis between the fuel inlet and the fuel outlet, the fuel injector comprising:

a body having an inlet portion, an outlet portion, and a passage disposed between the inlet portion and the outlet portion;

an armature disposed within the passage and displaceable along the axis relative to the body;

a spring disposed within the passage and applying a biasing force to the armature, the spring having a first end disposed proximate the armature and a second end opposite from the first end, the spring comprising a coil spring; and a spring stop disposed within the passage and having a first and second portion, the first portion including at least one projection engaging the passage, the at least one projection extending obliquely with respect to the axis and in a direction generally toward the inlet portion, wherein the seat further comprises a projection slidably engaging the first one of the first and second ends, the projection extending within the coil spring.

12. The fuel injector according to claim 11, wherein the projection tapers inwardly as the projection extends from the seat.

13. A method of assembling a fuel injector having a fuel inlet, a fuel outlet, a fuel passageway extending along an axis between the fuel inlet and the fuel outlet, a body having an inlet portion, an outlet portion, a passage extending between the inlet portion and the outlet portion, and an armature, the method comprising:

disposing within the passage the armature displaceable along the axis relative to the body;

disposing within the passage a spring applying a biasing force to the armature, the spring having a first end disposed proximate the armature and a second end opposite from the first end;

maintaining a seat in a first configuration adapted for applying a first pressure on the passage;

positioning the seat in the first configuration at a location along the axis with respect to the body for applying the biasing force; and releasing the seat to a second configuration adapted for applying a second pressure on the passage, the second pressure being greater than the first pressure.

14. A fuel injector having a fuel inlet, a fuel outlet, and a fuel passageway extending along an axis between the fuel inlet and the fuel outlet, the fuel injector comprising:

a body having an inlet portion, an outlet portion, and a passage disposed between the inlet portion and the outlet portion, the passage extending therethrough;

an armature disposed within the passage and displaceable along the axis relative to the body;

a spring disposed within the passage and applying a biasing force to the armature, the spring having a first end disposed proximate the armature and a second end opposite from the first end; and a spring stop disposed within the passage and having a first and second portion, the first portion including at least one projection engaging the passage, the at least one projection extending obliquely with respect to the axis and in a direction generally toward the inlet portion, the projection including a free end, the free end defining a diameter transverse and coincident to the axis, the diameter being greater, prior to installation of the spring stop in the passage, than an engagement diameter at a location along the axis in the passage where the free end engages the passage, and when installed in the passage, a diameter less than the engagement diameter of the passage.

* * * * *